US006012311A

United States Patent [19]

Duckwall

[11] Patent Number: 6,012,311

[45] Date of Patent: Jan. 11, 2000

[54] REMOVABLE CORE LOCK

[75] Inventor: Thomas Edwin Duckwall, Roanoke, Va.

[73] Assignee: Medeco Security Locks, Inc., Salem, Va.

[21] Appl. No.: 09/258,218

[22] Filed: Feb. 26, 1999

[51] Int. Cl.[7] ..... E05B 27/04

[52] U.S. Cl. ..... 70/369; 70/379 R; 70/380

[58] Field of Search ..... 70/367–371, 379 R, 70/379 A, 380, DIG. 62, 337

[56] References Cited

U.S. PATENT DOCUMENTS

| | | | |
|---|---|---|---|
| Re. 31,910 | 6/1985 | Oliver | 70/369 |
| 1,241,754 | 10/1917 | Molden | 70/380 |
| 1,840,469 | 1/1932 | Sabo | 70/380 |
| 1,850,586 | 3/1932 | Heyer | 70/380 |
| 1,905,639 | 4/1933 | Jacobi . | |
| 1,964,787 | 7/1934 | Voight | 70/369 |
| 2,036,764 | 4/1936 | Lowe | 70/91 |
| 2,460,709 | 2/1949 | Navarro | 70/369 |
| 3,955,387 | 5/1976 | Best et al. | 70/224 |
| 4,052,868 | 10/1977 | Best et al. | 70/224 |
| 4,055,973 | 11/1977 | Best | 70/58 |
| 4,075,878 | 2/1978 | Best | 70/49 |
| 4,123,926 | 11/1978 | Elder | 70/369 |
| 4,143,531 | 3/1979 | Floyd | 70/367 |
| 4,191,037 | 3/1980 | Patriquin | 70/369 |
| 4,195,503 | 4/1980 | Roberts | 70/366 |
| 4,272,975 | 6/1981 | Patriquin | 70/369 |
| 4,282,731 | 8/1981 | Taksony | 70/419 X |
| 4,312,201 | 1/1982 | Roos | 70/422 |
| 4,328,690 | 5/1982 | Oliver | 70/369 |
| 4,386,510 | 6/1983 | Best et al. | 70/369 |
| 4,424,693 | 1/1984 | Best et al. | 70/369 |
| 4,444,034 | 4/1984 | Best et al. | 70/369 |
| 4,539,828 | 9/1985 | Teleky | 70/371 X |
| 4,655,059 | 4/1987 | Best et al. | 70/224 |
| 4,703,638 | 11/1987 | Bergstrom | 70/419 X |
| 4,761,978 | 8/1988 | Walla | 70/367 |
| 4,809,525 | 3/1989 | Cox | 70/100 |
| 4,866,964 | 9/1989 | Hall | 70/369 |
| 4,998,422 | 3/1991 | Borgmann et al. | 70/38 A |
| 5,209,087 | 5/1993 | Cox | 70/369 |
| 5,398,531 | 3/1995 | Shen | 70/224 |
| 5,634,359 | 6/1997 | Huebschen | 70/379 R |
| 5,813,260 | 9/1998 | Widén | 70/369 |

FOREIGN PATENT DOCUMENTS

| | | | |
|---|---|---|---|
| 197236 | 4/1958 | Germany | 70/379 R |

*Primary Examiner*—Lloyd A. Gall

*Attorney, Agent, or Firm*—Rothwell, Figg, Ernst & Kurtz, P.C.

[57] ABSTRACT

A cylindrical "shell and plug" assembly has the plug rotatably received within the shell. The plug has a central rear shaft and an engagement portion thereon. The engagement portion has a pie-shaped stop member and a pie-shaped engagement member. A connecting member rotatably held within the shell has an inner engagement that can engage the pie-shaped engagement member and an operation key slot capable of receiving an end of an operation key. The plug can be rotated until the engagement member is positioned behind the flange to retain the plug with the connecting member, and the plus can be rotated so that the engagement member can be positioned away from the flange, thereby permitting the plug to become disengaged from the connecting member.

24 Claims, 5 Drawing Sheets

REMOVABLE CORE LOCK

BACKGROUND OF THE INVENTION

1. Field of the Invention

The present invention relates generally to mechanical locks, and more particularly, to "shell and core assemblies" that have a cylindrical shell mountable on a wall of an enclosure and a removable core.

2. Description of the Background Art

A variety of mechanical locks are known, including locks to secure dwellings, buildings, vehicles, compartments, access hatches, gates, etc. Mechanical locks typically have a rotatable plug containing a key slot. The insertion of a correctly-bitted key displaces tumbler pins within the plug, thereby allowing the plug to rotate. The rotation of the plug actuates a locking bolt or the like that locks or unlocks the structure that the lock is a part of. If the key is not a correctly-bitted key, either the key will not be able to fully enter the slot, or the lock will not be allowed to rotate. "Shell and core" lock assemblies are known wherein the lock components include separate "cylindrical shells" and "cores" that can "together" be installed in a wall of an enclosure, transported by a manufacturer, and removed from the enclosure for replacement. "Shell and core" lock assemblies have also been enhanced by the provision of "removability" of the "core" from the "shell" by the use of a special key, to facilitate lock replacement. In a removable core lock, the plug, including the key slot and tumbler pins, can be removed from the lock while leaving the remaining lock mechanism in place. A removable core lock offers the advantage of being able to easily and cheaply change the keying of the lock without removing and replacing all of the lock apparatus. Removable core locks may be commonly used in applications such as casinos, dormitories, hotels or motels, lockers, rental units, or other applications where re-keying of locks is anticipated. The advantages include not only a lesser cost in hardware replacement, but also significant time and labor savings.

These removable core locks have suffered from several drawbacks. First, these removable core locks have commonly contained a complicated structure, e.g., with the cores being retained in the shell by a tumbler pin or another movable internal retaining device. When the core is removed from such locks, these retaining devices have an unfortunate propensity for falling out of the lock or becoming unseated from a desired position. Second, such removable cores can be difficult to install and remove.

An old device outside of the context of a "shell and core" assembly (i.e., having a core that is alone removable from an automobile handle) is shown in U.S. Pat. No. 2,036,764 to Lowe. In Lowe, the removable core is retained inside the handle via two thin L-shaped arms extended from the plug. The Lowe device has several drawbacks. First, the device does not relate to a transportable and/or removable "shell and core" assembly. Second, each L-shaped arm has a lower level of strength and durability. Third, the L-shaped arms can be hard to align if the L-shaped arms 24 become twisted or bent during handling of the plug.

What is needed is a "shell and core" lock assembly that can be sold and delivered as a unit by a manufacturer for incorporation in enclosures, wherein the core can be easily and efficiently removed and replaced without problems of existing removable core devices and with increased strength and durability.

SUMMARY OF THE INVENTION

A removable core lock assembly is provided according to a first aspect of the invention. The removable core lock assembly includes an enclosure having a front wall, a cylindrical shell mounted in the front wall with a front opening of the shell proximate the front wall, with the cylindrical shell also having a rear opening, a removable plug received within the front opening of the shell and being rotatable in the shell and having tumbler pins which engage the shell, the removable plug including a key slot and further including a locking bar disposed on an outer circumferential surface of the removable plug, with the locking bar being retractable when a correctly bitted key is inserted, the removable plug including a central rear shaft and an engagement portion thereon, the engagement portion having a pie-shaped stop member and a pie-shaped engagement member on the central rear shaft, the pie-shaped stop and engagement members being directly adjacent one another and both extending over an arc of at least ninety degrees, a connecting member rotatably held within the shell, with the connecting member including a shaft extending through the rear opening in the shell, a semi-circular inner engagement member including an operation key slot capable of receiving an end of an operation key, and a circumferential wall extending around an arc of greater than ninety degrees and an overhanging flange extending inward from said circumferential wall, and a locking plate fixed to the shaft and rotatable therewith, with the shell including a limiting projection which limits rotational movement of the locking plate, wherein the removable plug can be rotated until the pie-shaped stop member of the rotatable plug contacts the flange of the connecting member, so that the pie-shaped engagement member of the removable plug can be positioned behind the flange, the pie-shaped engagement member and the flange cooperating to retain the removable plug with the connecting member, and the removable plug can be rotated so that the pie-shaped engagement member can be positioned away from the flange, thereby permitting the removable plug to become disengaged from the connecting member and removed from the removable core lock.

A removable core lock is provided according to a second aspect of the invention. The removable core lock includes a cylindrical shell having a front opening and a rear opening, a removable plug received within the front opening of the shell and being rotatable in the shell and having tumbler pins which engage the shell, the removable plug including a key slot and further including a locking bar disposed on an outer circumferential surface of the removable plug, with the locking bar being retractable when a correctly bitted key is inserted, the removable plug including a central rear shaft and an engagement portion thereon, the engagement portion having a pie-shaped stop member and a pie-shaped engagement member on the central rear shaft, the pie-shaped stop and engagement members being directly adjacent one another and both extending over an arc of at least ninety degrees, a connecting member rotatably held within the shell, with the connecting member including a shaft extending through the rear opening in the shell, a semi-circular inner engagement member including an operation key slot capable of receiving an end of an operation key, and a circumferential wall extending around an arc of greater than ninety degrees and an overhanging flange extending inward from said circumferential wall, and a locking plate fixed to the shaft and rotatable therewith, with the shell including a limiting projection which limits rotational movement of the locking plate, wherein the removable plug can be rotated until the pie-shaped stop member of the rotatable plug contacts the flange of the connecting member, so that the pie-shaped engagement member of the removable plug can be positioned behind the flange, the pie-shaped engagement member and the flange cooperating to retain the removable plug with the connecting member, and the removable plug can be rotated so that the pie-shaped engagement member can be positioned away from the flange, thereby permitting the removable plug to become disengaged from the connecting member and removed from the removable core lock.

A removable core lock is provided according to a third aspect of the invention. The removable core lock includes a cylindrical shell having a front opening and a rear opening, a removable plug received within the shell and being rotatable in the shell and having tumbler pins which engage the shell, the removable plug including a key slot and further including a locking bar disposed on an outer circumferential surface of the removable plug, with the locking bar being retractable when a correctly bitted key is inserted, the removable plug including a central rear shaft and an engagement portion thereon, the engagement portion having a pie-shaped stop member and a pie-shaped engagement member on the central rear shaft, the pie-shaped stop and engagement members being directly adjacent one another and both extending over an arc of at least ninety degrees, and a connecting member rotatably held within the shell, with the connecting member including a shaft extending through the rear opening in the shell and capable of being rotated to operate the removable core lock, a semi-circular inner engagement member including an operation key slot capable of receiving an end of an operation key, and a circumferential wall extending around an arc of greater than ninety degrees and an overhanging flange extending inward from said circumferential wall, wherein the removable plug can be rotated until the pie-shaped stop member of the rotatable plug contacts the flange of the connecting member, so that the pie-shaped engagement member of the removable plug can be positioned behind the flange, the pie-shaped engagement member and the flange cooperating to retain the removable plug with the connecting member, and the removable plug can be rotated so that the pie-shaped engagement member can be positioned away from the flange, thereby permitting the removable plug to become disengaged from the connecting member and removed from the removable core lock.

The above and other features and advantages of the present invention will be further understood from the following description of the preferred embodiment thereof, taken in conjunction with the accompanying drawings.

DETAILED DESCRIPTION OF THE PREFERRED EMBODIMENTS

Figure 1A:
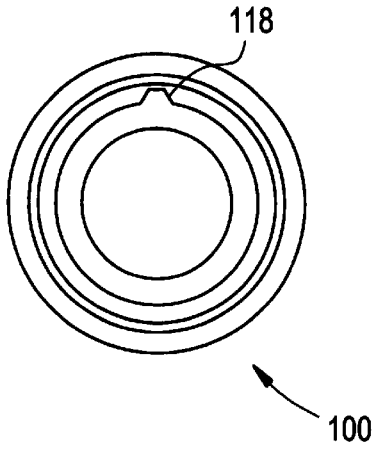
FIGS. 1(A)–1(C) show a cylindrical shell of the present invention.
Figure 1B:
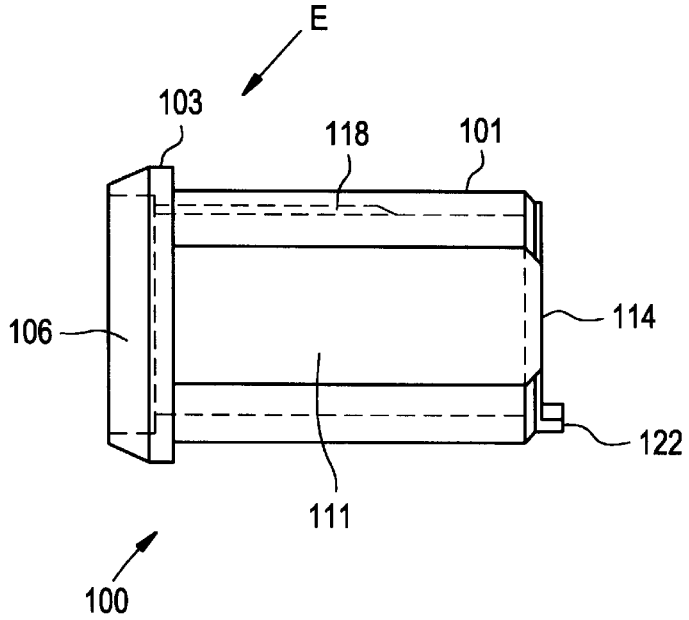
Figure 1C:
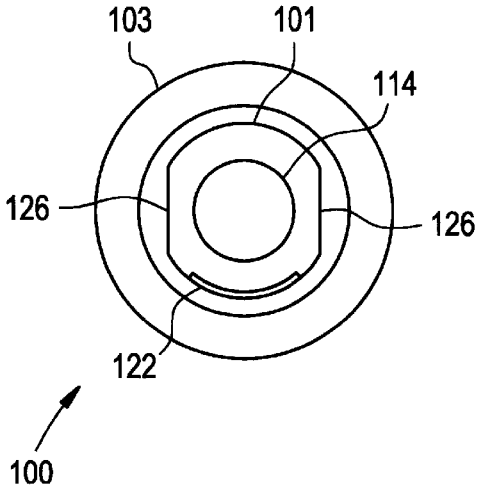

FIGS. 1(A)–1(C) show a cylindrical shell 100 according to a preferred embodiment of the present invention. The cylindrical shell 100 includes a barrel 101, a rim 103, a front opening 106, a substantially cylindrical cavity 111, a rear opening 114, a groove 118, a limiting projection 122, and flat surfaces 126 on opposite sides of the barrel 101.

The cylindrical cavity 111 is shaped to receive a removable plug 200, discussed in conjunction with FIGS. 2(A)–2(D) below. The groove 118 is formed on an inner surface of the barrel 101 and is shaped to retain a locking bar (discussed below) on the removable plug 200.

Figure 6A:
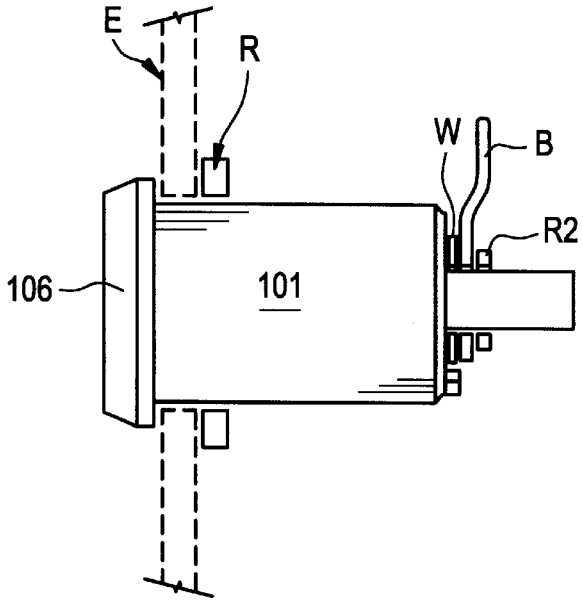
FIG. 6(A) shows a side view of a "shell and core" assembly according to the invention installed in an enclosure.
Figure 6B:
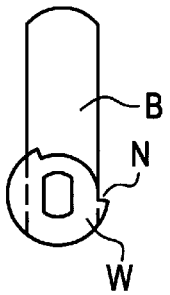
FIG. 6(B) shows the locking plate, taken alone, in FIG. 6(A) from the left side of FIG. 6(A)

In use, as shown in FIG. 6(A), the barrel 101 is inserted into a hole in a wall or door E of an enclosure to be locked. Preferably, the hole in the wall or door E has flat sides corresponding to the flat surfaces 126 of the barrel 101, as seen in FIG. 1(C). The flat surfaces 126 can thereby prevent the cylindrical shell 100 from rotating in the hole. The cylindrical shell 100 is positioned with the rim 103 against the wall or door E to be locked, and the cylindrical shell 100 is immobilized in that position by a retainer R that can be affixed to the barrel 101. In the preferred embodiment, the retainer R is a threaded nut, and the barrel 101 has a corresponding threaded outer surface (not shown) for receiving the threaded nut. Alternatively, the retainer may be a friction-fit ring, a spring clip, or other like device.

The rear opening 114 allows an inner component of the lock to protrude from the rear of the cylindrical shell 100. A limiting projection 122 disposed on the rear of the cylindrical shell 100 may be used to limit the lock to a predetermined range of rotation (as discussed below).

Figure 2A:
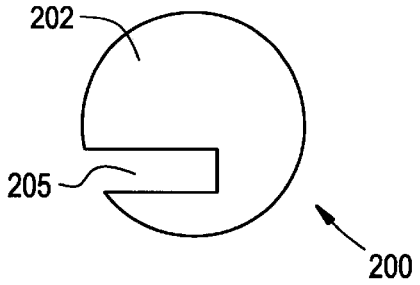
FIGS. 2(A)–2(B) show a removable plug of the present invention.

FIGS. 2(A)–2(D) show a removable plug 200 according to a preferred embodiment of the present invention. FIG. 2(A) shows the removable plug 200 from a head-on position, displaying an outer face 202. The outer face 202 will be the only visible portion of the removable plug 200 when installed in the cylindrical shell 100. As also shown in FIG. 2(A), the plug includes a key slot 205 for receiving a key (discussed below).

Figure 2B:
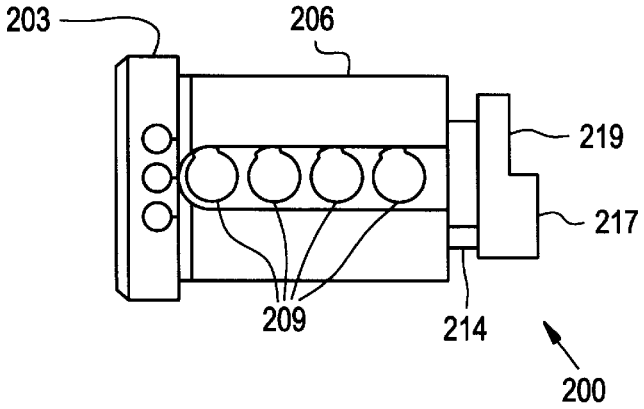
Figure 2C:
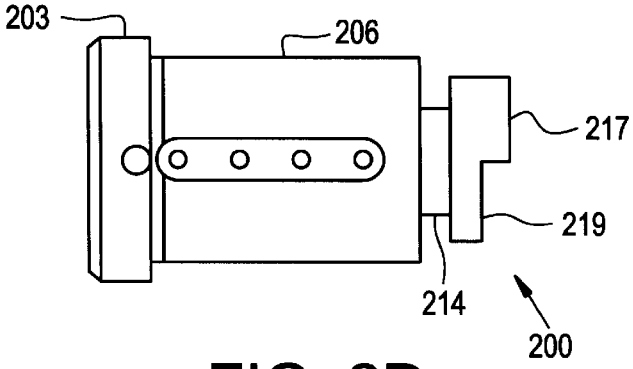

FIGS. 2(B) and 2(C) show opposing sides of the removable plug 200. The removable plug 200 has a front portion 203, a plug body 206, a plurality of tumbler pin holes 209, a central rear shaft 214, an engagement member 219, and a stop member 217. The front portion 203 is of a diameter substantially equal to the front opening 106 of the cylindrical shell 100. The plug body 206 is of a diameter substantially equal to the inner diameter of the cylindrical cavity 111.

Figure 2D:
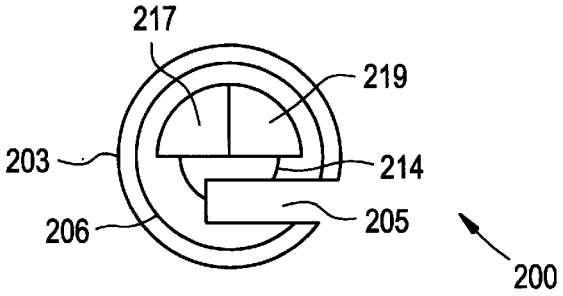
Figure 3B:
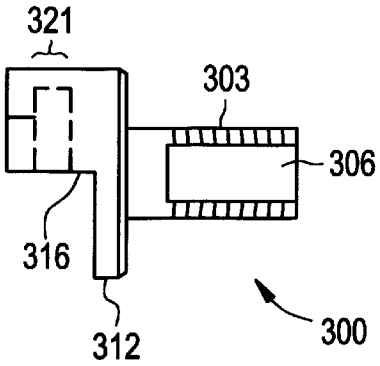
FIGS. 3(A)–3(D) show a connecting member of the present invention.
Figure 3D:
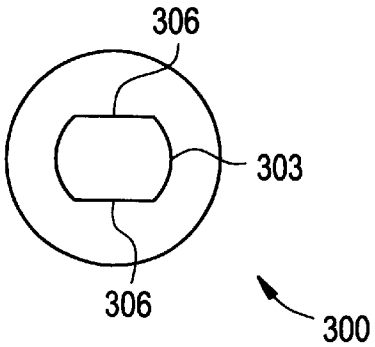
Figure 3A:
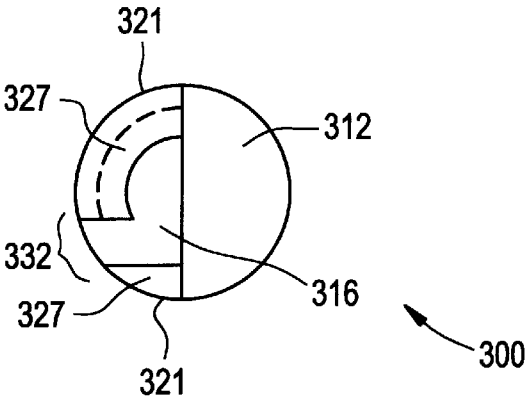
Figure 3C:
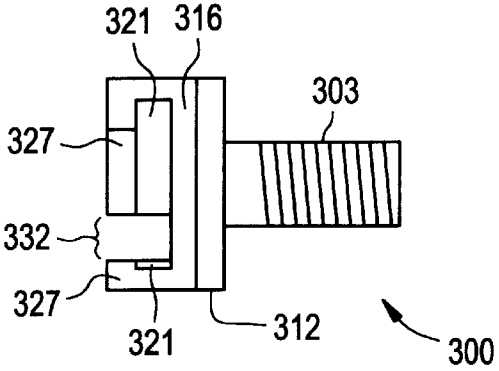

The central rear shaft 214 supports the stop member 217 and the engagement member 219. The stop and engagement members 217 and 219, as can be seen in FIG. 2(D), are preferably pie-shaped. Both members preferably have two flat side surfaces that meet at an apex and form an angle, and a third, circular surface joining said flat side surfaces and positioned opposite said apex. In the illustrated embodiment, the stop member 217 extends over an arc of about ninety degrees, while the engagement member 219 extends over an arc of about one hundred and eighty degrees. It should be understood that the sizes of the pie-shaped stop and engagement members 217 and 219 may be varied in accordance with the invention. The engagement member 219 and the stop member 217 cooperate with the connecting member 300 (discussed below) to make the removable plug 200 easily insertable and removable from the lock, as will be discussed below in conjunction with FIG. 4 and FIG. 5.

FIGS. 3(A)–3(D) show the connecting member 300 according to the preferred embodiments of the present invention. The connecting member 300 includes a shaft 303 having flat surfaces 306, a circular surface 312, a semi-circular pad 316 disposed on the circular surface 312, a circumferential wall 321 extending around an arc of preferably greater than ninety degrees, an overhanging flange 327 extending inward from the circumferential wall 321, and an operation key slot 332 formed in and interrupting the circumferential wall 321 and the flange 327.

The rear shaft 303 is sized to protrude through the rear opening 114 of the cylindrical shell 100. In a preferred embodiment, the rear shaft 303 is threaded so that the connecting member 300 may be retained in the cylindrical shell 100 by a retainer device R2, see FIG. 6A. In a preferred embodiment, the retainer device R2 is a threaded nut, but alteratively the retainer device may be a friction-fit ring, spring clip, or other like device. In the preferred embodiment a radially-outward locking plate B is positioned between the retainer device R2 and the cylindrical shell 100. The locking plate includes a through-hole for receiving the rear shaft 303. Preferably, a washer W is provided between the locker plate B and the shell. The washer W is fixed to the locking plate B and has a perimeter with a notch N that operates to engage the projection 122 to limit rotation between the connector 300 and the shell (in the illustrated embodiment, rotation is limited to about 90° ). The locking plate B is held in fixed relation to the rear shaft 303—e.g., by a hole having flat sides, similar to the relationship between the shell and the wall or door E.

The assembled lock includes the removable plug 200 positioned inside the cylindrical shell 100, engaged with the connecting member 300. In addition, the lock preferably includes tumbler pins inside the tumbler pin holes 209. In a preferred embodiment, a locking bar is also positioned adjacent the tumbler pins and capable of retracting into the removable plug 200 upon a proper rotational position of the tumbler pins. The locking bar can operate as is known in the art, see, for example, the latch bar 56 of Re. 31,910 to Oliver, for a Removable Core Cylinder Lock, the disclosure of which is incorporated herein by reference. The insertion of a correctly-bitted key may therefore displace the tumbler pins to a shear line elevation and rotate the tumbler pins to retract the locking bar into the removable plug 200. A long "operation" key will extend through both the removable plug 200 and the connecting member 300 to thereby rotate the plug and the connecting member, and thus the locking plate B to lock or unlock the removable core lock.

Figure 5:
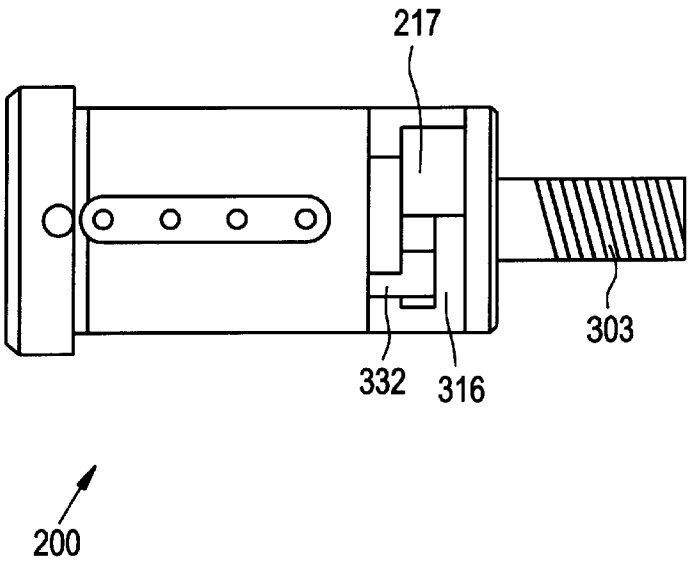
FIG. 5 shows the removable plug and the connecting member in an engaged position.
Figure 4:
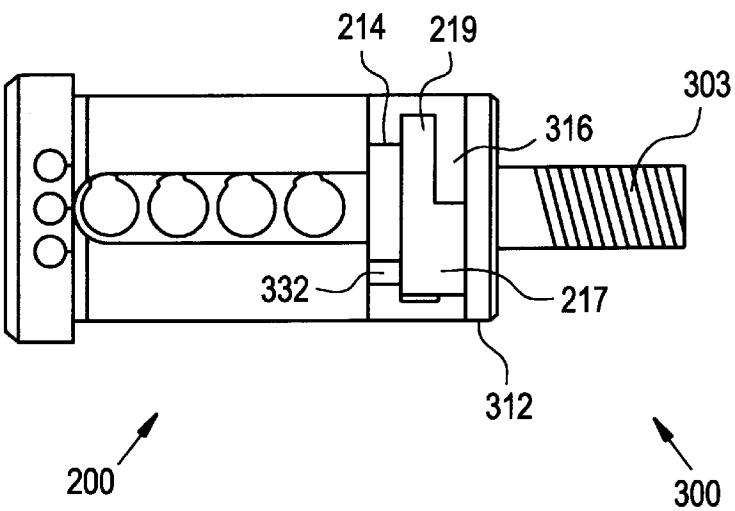
FIG. 4 shows the removable plug and the connecting member in a disengaged position.

FIG. 4 shows the removable plug 200 and the connecting member 300 when the removable plug 200 and the connecting member 300 are disengaged (the cylindrical shell is not shown in either FIG. 4 or FIG. 5 for purposes of clarity). The disengaged position occurs at both insertion and removal of the removable plug 200. In this position, the pie-shaped or semi-circular components of the removable plug 200 (i.e., the combination of the stop member 217 and the engagement member 219) occupy the open space opposite the semi-circular pad 316, wall 321, and flange 327.

FIG. 5 shows these components in an engaged position. The removable plug 200 has been rotated approximately ninety degrees from the position shown in FIG. 4, until the stop member 217 contacts the semi-circular pad 316. In this engaged position, the engagement member 219 of the removable plug 200 is positioned underneath the flange 327, and is held between the flange 327 and the semi-circular pad 316. The approximately ninety degree arc of the pie-shaped engagement member 219 is held under the flange 327 away from the operation key slot 332, so that a wide expanse of the engagement member 219 contacts the flange 327.

In the engaged position, the key slot 205 of the removable plug 200 is aligned with the operation key slot 322 of the connecting member 300. Therefore, in the engaged position, a long "operation" key may be inserted into the lock, with the operation key extending into the operation key slot 332.

Figure 7A:
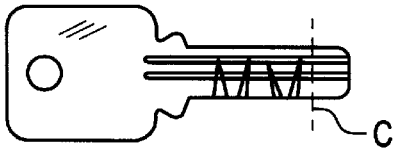
FIG. 7(A) shows an operation key according to one embodiment.
Figure 7B:
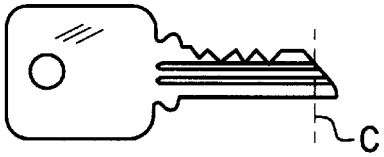
FIG. 7(B) shows an operation key according to another embodiment.

The insertion and removal of the removable plug 200 is accomplished by a "removal" key. The removal key is bitted the same as the operation key, but it is shortened so that it does not extend into the operation key slot 332. Therefore, when a removal key is inserted into the lock, the removal key can only rotate the removable plug 200 and cannot rotate the connecting member 300. As shown by the dashed line C in FIGS. 7(A) and 7(B), the removal key can be shortened to a position C, for example, so that it includes the bitting areas but does not extend into the member 300 when inserted. As shown in FIGS. 7(A) and 7(B), the operation key can be, FIG. 7(A), a horizontal key with bittings on a flat side (the illustrated embodiments) or it can be, FIG. 7(B), a vertical key with bittings on the narrow width of the key.

Thus, the operation key is the key that may be used to lock or unlock the device in normal operation and differs from the removal key by being long enough to extend into the operation key slot 332. Therefore, the operation key rotates both the removable plug 200 and the connecting member 300, and is incapable of rotating only the removable plug 200. As a result, the operation key cannot disengage or remove the removable plug 200 from the lock.

Accordingly, with the present invention a "shell and core" assembly can be delivered to an installation location for an enclosure. The shell can be attached to the enclosure and the core can be removably retained in the enclosure. The plug can be removed as described hereinabove and preferably the shell can also be removed as described. The plug also has an improved engagement that not only avoids the use of movable parts, e.g., pins, to be removed from the shell, but which has an improved and durable engagement member that can be easily manufactured and can be handled without substantial risk of damage, etc., that would potentially cause damage or interfere with operation.

While the invention has been described in detail above, the invention is not intended to be limited to the specific embodiments as described. It is evident that those skilled in the art may now make numerous uses and modifications of and departures from the specific embodiments described herein without departing from the inventive concepts.

What is claimed is:

1. An assembly, comprising:

an enclosure having a front wall;

a cylindrical shell mounted in said front wall with a front opening of said shell proximate said front wall, with said cylindrical shell also having a rear opening;

a removable plug received within said front opening of said shell and being rotatable in said shell and having tumbler pins which engage said shell, said removable plug including a key slot and further adapted to include a locking bar disposed on an outer circumferential surface of said removable plug, with said locking bar being retractable when a correctly bitted key is inserted, said removable plug including a central rear shaft and an engagement portion thereon, said engagement portion having a pie-shaped stop member and a pie-shaped engagement member on said central rear shaft, with said pie-shaped stop and engagement members being directly adjacent one another and both extending over an arc of at least ninety degrees;

a connecting member rotatably held within said shell, with said connecting member including a shaft extending through said rear opening in said shell, a semicircular inner engagement member including an operation key slot capable of receiving an end of an operation key, and a circumferential wall extending around an arc of greater than ninety degrees and an overhanging flange extending inward from said circumferential wall; and a locking plate fixed to said shaft and rotatable therewith, with said shell including a limiting projection which limits rotational movement of said locking plate;

wherein said removable plug can be rotated until said pie-shaped stop member of said rotatable plug contacts said connecting member, with said pie-shaped engagement member of said removable plug positioned under said flange, said removable plug being rotatable so that said pie-shaped engagement member can be removed from under said flange to permit said removable plug to become disengaged from said connecting member and removed from said shell.

2. The assembly of claim 1, wherein said pie-shaped stop and engagement members have two flat side surfaces that meet at an apex and form an angle and a third circular surface joining said flat side surfaces and positioned opposite said apex.

3. The assembly of claim 1, wherein said pie-shaped engagement member of said removable plug extends over an arc of about one hundred and eighty degrees.

4. The assembly of claim 1, wherein said pie-shaped stop member of said removable plug extends over an arc of about ninety degrees.

5. The assembly of claim 1, including a removal key that is capable of rotating said removable plug without rotating said connecting member.

6. The assembly of claim 5, wherein said removal key is not capable of extending into said operation key slot of said connecting member.

7. The assembly of claim 1, includes an operation key that rotates said removable plug in conjunction with said connecting member.

8. The assembly of claim 7, wherein said operation key extends into said operation key slot of said connecting member.

9. A removable core lock, comprising:

a cylindrical shell having a front opening and a rear opening;

a removable plug received within said front opening of said shell and being rotatable in said shell and having tumbler pins which engage said shell, said removable plug including a key slot and further adapted to include a locking bar disposed on an outer circumferential surface of said removable plug, with said locking bar being retractable when a correctly bitted key is inserted, said removable plug including a central rear shaft and an engagement portion thereon, said engagement portion having a pie-shaped stop member and a pie-shaped engagement member on said central rear shaft, with said pie-shaped stop and engagement members being directly adjacent one another and both extending over an arc of at least ninety degrees;

a connecting member rotatably held within said shell, with said connecting member including a shaft extending through said rear opening in said shell, a semicircular inner engagement member including an operation key slot capable of receiving an end of an operation key, and a circumferential wall extending around an arc of greater than ninety degrees and an overhanging flange extending inward from said circumferential wall; and a locking plate fixed to said shaft and rotatable therewith, with said shell including a limiting projection which limits rotational movement of said locking plate;

wherein said removable plug can be rotated until said pie-shaped stop member of said rotatable plug contacts said connecting member with said pie-shaped engagement member of said removable plug positioned under said flange, said removable plug being rotatable so that said pie-shaped engagement member can be removed from under said flange, to permit said removable plug to become disengaged from said connecting member and removed from said shell.

10. The removable core lock of claim 9, wherein said pie-shaped stop and engagement members have two flat side surfaces that meet at an apex and form an angle and a third circular surface joining said flat side surfaces and positioned opposite said apex.

11. The removable core lock of claim 9, wherein said pie-shaped engagement member of said removable plug extends over an arc of about one hundred and eighty degrees.

12. The removable core lock of claim 9, wherein said pie-shaped stop member of said removable plug extends over an arc of about ninety degrees.

13. The removable core lock of claim 9, further includes a removal key that is capable of rotating said removable plug without rotating said connecting member.

14. The removable core lock of claim 13, wherein said removal key is not capable of extending into said operation key slot of said connecting member.

15. The removable core lock of claim 9, further includes an operation key that rotates said removable plug in conjunction with said connecting member.

16. The removable core lock of claim 15, wherein said operation key extends into said operation key slot of said connecting member.

17. A removable core lock, comprising:

a cylindrical shell having a front opening and a rear opening;

a removable plug received within said shell and being rotatable in said shell and having tumbler pins which engage said shell, said removable plug including a key slot, said removable plug including a central rear shaft having an outwardly extending pie-shaped engagement member thereon; and a connecting member rotatably held within said shell, with said connecting member including a shaft extending through said rear opening in said shell, an inner engagement member including an operation key slot capable of receiving an end of an operation key and a circumferential wall extending around an arc of at least ninety degrees and an overhanging flange extending inward from said circumferential wall;

wherein said removable plug can be rotated until said pie-shaped engagement member of said removable plug is positioned behind said flange, said pie-shaped engagement member and said flange cooperating to retain said removable plug with said connecting member, and said removable plug can be rotated so that said pie-shaped engagement member can be positioned away from said flange, thereby permitting said removable plug to become disengaged from said connecting member and removed from said shell.

18. The removable core lock of claim 17, wherein said pie-shaped engagement member has two flat side surfaces that meet at an apex and form an angle and a third circular surface joining said flat side surfaces and positioned opposite said apex.

19. The removable core lock of claim 17, wherein said pie-shaped engagement member of said removable plug extends over an arc of more than about 90 degrees.

20. The removable core lock of claim 17, further including a pie-shaped stop member.

21. The removable core lock of claim 17, further including a removal key that is capable of rotating said removable plug without rotating said connecting member.

22. The removable core lock of claim 21, wherein said removal key is shortened so as not to extend into said operation key slot of said connecting member.

23. The removable core lock of claim 17, further including an operation key that rotates said removable plug in conjunction with said connecting member.

24. The removable core lock of claim 23, wherein said operation key extends into said operation key slot of said connecting member.

* * * * *